US005542236A

United States Patent [19]

Miller

[11] Patent Number: 5,542,236

[45] Date of Patent: Aug. 6, 1996

[54] METHOD OF DISPENSING UNIT DOSES OF MEDICATIONS AND ASSOCIATED PRODUCTS

[76] Inventor: Irwin Miller, 4111 Mischire St., Houston, Tex. 77025

[21] Appl. No.: 240,022

[22] Filed: May 9, 1994

[51] Int. Cl.[6] ..... B65B 5/08; B65B 5/10

[52] U.S. Cl. ..... 53/467; 53/475

[58] Field of Search ..... 53/474, 475, 467, 53/471, 427, 492, 453, 468; 221/1

[56] References Cited

U.S. PATENT DOCUMENTS

| | | | |
|---|---|---|---|
| 3,031,072 | 4/1962 | Kraut | 53/427 X |
| 3,874,143 | 4/1975 | Braber | 53/453 X |
| 4,219,987 | 9/1980 | Hannon | 53/427 |

*Primary Examiner*—Horace M. Culver
*Attorney, Agent, or Firm*—David V. Radack; Eckert Seamans Cherin & Mellott

[57] ABSTRACT

A method of dispensing unit doses of medications to a patient. A card including a blister pack having a plurality of medication receiving recesses is provided. The recesses are arranged in a plurality of rows, with the rows having weakened lines therebetween. A row of the card is separated from the card along the weakened lines and is then placed in the carrier. In this way, the unit doses of medications in the separated row are available for dispensing to the patient. A card containing a plurality of unit doses of medication, a carrier for holding a blister pack having a plurality of medication receiving recesses arranged in a row and a medication dispensing apparatus are also disclosed.

9 Claims, 8 Drawing Sheets

METHOD OF DISPENSING UNIT DOSES OF MEDICATIONS AND ASSOCIATED PRODUCTS

BACKGROUND OF THE INVENTION

This invention relates to a method of dispensing unit doses of medications and associated products and more particularly to providing a card including a blister pack having a plurality of medication receiving recesses, each of the recesses containing a unit dose of medication, the recesses being arranged in a plurality of separable rows and a carrier into which the separated rows may be placed.

Advances in medical science and pharmacology have lead to a proliferation of prescription drugs that are taken by many persons. Often, some persons may take several different types of prescription drugs in the same day. These prescription drugs may be taken once, twice, or more times daily.

One major problem that has arisen is patient compliance with the dosing schedule of the various prescription drugs that are needed by that patient. For example, one patient may require four different prescriptions, to be taken anywhere from once to four times daily. As can be appreciated, this requires careful monitoring because missing a dose or "doubling-up" on a dose can have major negative health effects on a patient. The problem is multiplied in a hospital or nursing home situation when there are many patients, most of whom require sometimes many prescriptions at varying times of the day. Thus, what is needed is a system that increases patient compliance, reduces administration errors and accurately tracks scheduled dosages.

Finally, with the current emphasis on delivering quality health care at a reasonable cost, there is needed an efficient system that allows for increased inventory control as well as more efficient patient billing. A system is needed, therefore, that is easy to use by the patient but which also provides pharmacists and administrators an efficient and accurate method to dispense and bill for the prescription drugs.

SUMMARY OF THE INVENTION

The invention has met the above needs. The method of dispensing unit doses of medications comprises providing a card including a blister pack having a plurality of medication receiving recesses, each of the recesses being arranged in a plurality of rows with the rows having weakened lines therebetween. The method further comprises separating a row of the unit doses of medication from the card by means of the weakened lines and then placing the separated row in a carrier. In this way, the unit doses of medications in the separated row are available for dispensing to a patient.

The invention also includes a card containing a plurality of unit doses of medication. The card comprises a blister pack having a plurality of medication receiving recesses each containing a unit dose of medication. The recesses are arranged in a plurality of rows with each row containing a plurality of unit doses of medication. The card includes weakened lines between rows so the rows are separable from the card but does not include weakened lines between individual unit doses of medications in the same row so that individual unit doses of medications in the same row cannot be easily separated from each other.

A carrier for holding a blister pack having a plurality of medication receiving recesses arranged in a row is also provided. The carrier has a base, a pair of opposed sidewalls extending from the base and retaining means disposed on the sidewalls. The retaining means and the base define a space adapted to receive a portion of the blister pack.

The invention also includes the combination of the carrier and a blister pack having a plurality of medication receiving recesses arranged in a row.

BRIEF DESCRIPTION OF THE DRAWINGS

A full understanding of the invention can be gained from the following description of the preferred embodiment when read in conjunction with the accompanying drawings in which.

DETAILED DESCRIPTION

As used herein, the term "patient" means a human or animal, whether sick or not.

As used herein, the term "information" means words, numbers, symbols or colors that convey a meaning to a health care worker or a patient.

As used herein, the term "health care institution" means a hospital, nursing home, convalescent home, hospice, prisons, sub-acute facilities, mental health institutions, and assisted living institutions.

As used herein, the term "pharmacy" means a place where prescription drugs are dispensed and includes a drug store on or off the premises of a health care institution.

Figure 1:
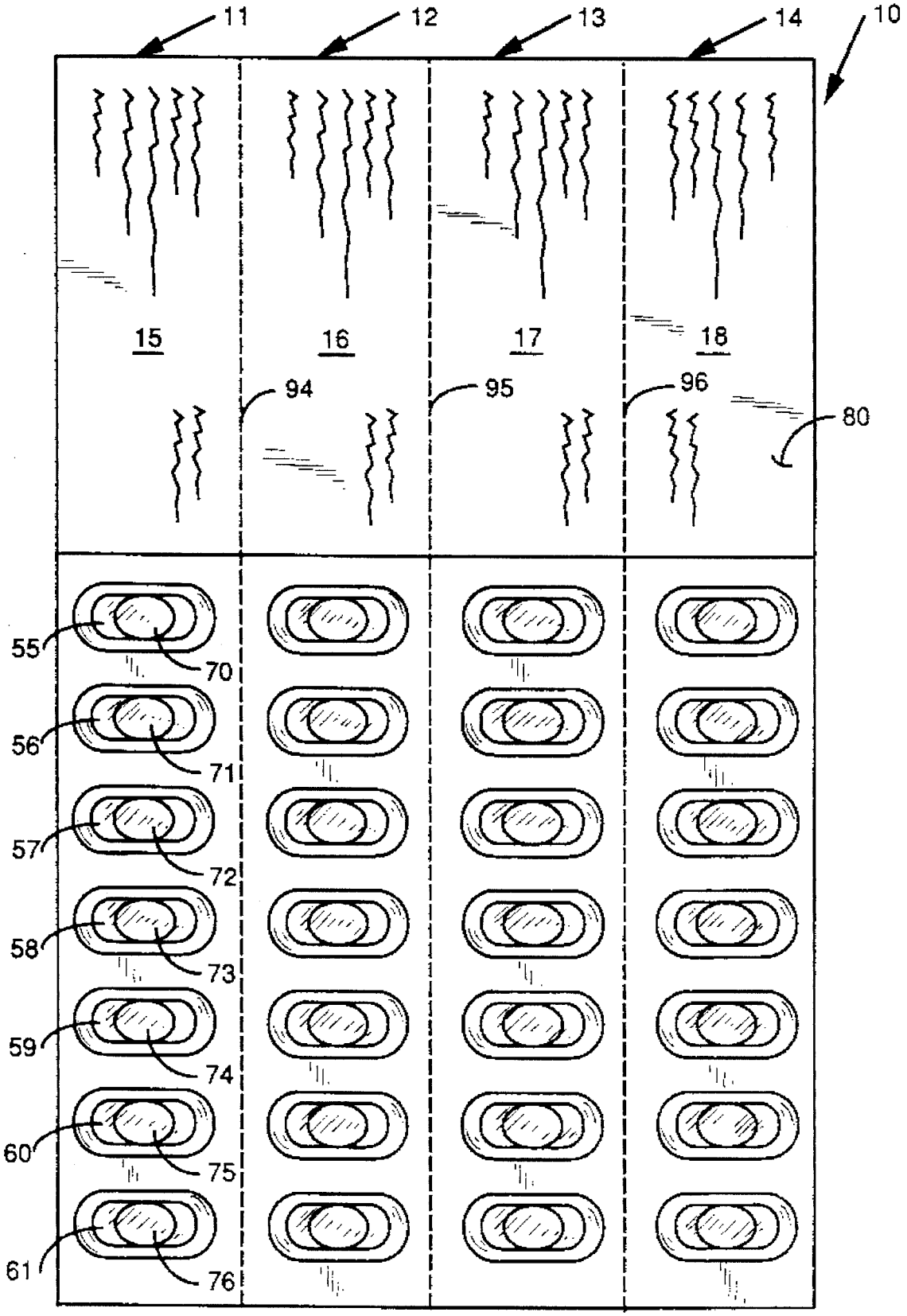
FIG. 1 is a top plan view of the prescription card of the invention.
Figure 2:
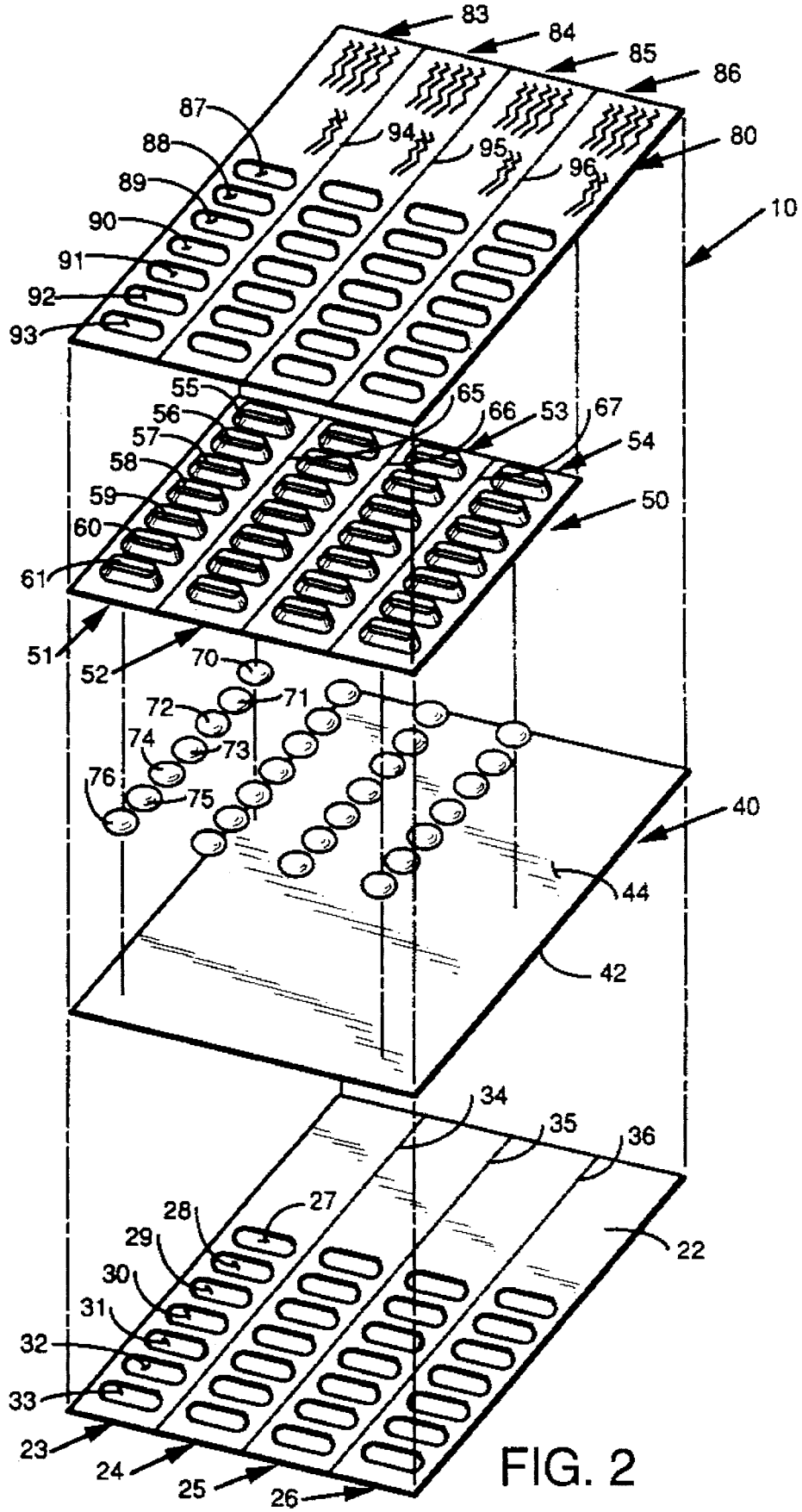
FIG. 2 is an exploded perspective view of the prescription card shown in FIG. 1.

Referring to FIGS. 1 and 2, the card 10 of the invention will be discussed. As can be seen in FIG. 1, the card 10 consists of four rows 11, 12, 13, 14 separated by weakened lines. Each row contains a portion 15, 16, 17, 18 that has medication identification indicia printed thereon, such as the patient's name, the name of the prescription drug and the pharmacist's name. The medication identification indicia can vary pursuant to the requirements of the laws and regulations as determined by the use setting and appropriate state law. The card 10 contains twenty-eight separate unit doses of medication (four rows of seven doses each) so that it can be used for four weeks' dosages, with each row representing one week's dosages.

Referring to FIG. 2, the card 10 consists of several components which are secured together. The first component is a base 22, made preferably of cardboard, which defines a plurality of holes. It is preferred that the number of holes be twenty-eight, arranged in four rows 23, 24, 25 and 26, having seven holes, such as 27, 28, 29, 30, 31, 32 and 33 in row 23, in each row. The card 10 can then be filled with twenty-eight days, or four weeks, worth of unit doses of medication. The rows 23, 24, 25, 26 are separated by weakened lines 34, 35 and 36, which can be perforations or scoring lines to facilitate separation of the assembled rows from the card 10 as will be explained further below.

The next component is a frangible foil layer 40, such as an aluminum foil, which is co-extensive with the base 22 and which covers the holes in the base 22. The lower surface 42 of the foil layer is glued to the base 22 or the base 22 and foil layer 40 can be provided as one unit. Glued to the upper surface 44 of the foil layer 40 is a blister pack 50 containing twenty-eight medication receiving recesses. It will be appreciated that only the edge portions of the blister pack are secured to the foil layer in order to create the medication receiving recesses. The medication receiving recesses are aligned in four rows 51, 52, 53, 54 having seven medication receiving recesses, such as medication receiving recesses 55, 56, 57, 58, 59, 60 and 61 in row 51, in each row. It will be appreciated that when secured to the upper surface 44 of the foil layer 40 and the base 22, that the medication receiving recesses are aligned with the holes in the base 22. The rows 51–54 are separated by weakened lines 65, 66 and 67 which can be perforations or scoring lines to facilitate separation of the assembled rows from the card 10 as will be explained further below. As can be seen, the unit doses of medication, such as unit doses 70, 71, 72, 73, 74, 75 and 76 are adapted to be placed in medication receiving recesses 55–61.

Finally, a top portion 80, which is similar in construction, design and dimension to base 22 is secured to the upper surface of the edge portions of the blister pack 50 to form the card. The top portion 80 is arranged in four rows 83, 84, 85 and 86 having seven holes such as holes 87, 88, 89, 90, 91, 92 and 93 in row 83, in each row. The rows 83–86 are separated by weakened lines 94, 95 and 96 which can be perforations or scoring lines to facilitate separation of the assembled rows on the card 10 as will be explained further below.

A preferred method of assembling the card 10 involves providing a mold which includes a platen having twenty-eight holes that correspond to the holes in the card. Placed on the platen is top portion 80 in such a way that the holes in the top portion 80 align with the holes in the mold. After this, the blister pack 50 is placed upside down (with the orientation of FIG. 2 being defined as right side up) so that the open end of the recesses face upwardly and so that the recesses extend into the holes in the mold. After this, the unit doses of medication are loaded into the recesses. Finally, the base 22, containing foil layer 40 is placed on top of the blister pack 50. The stack is then pressure and heat sealed to form card 10.

Figure 3:
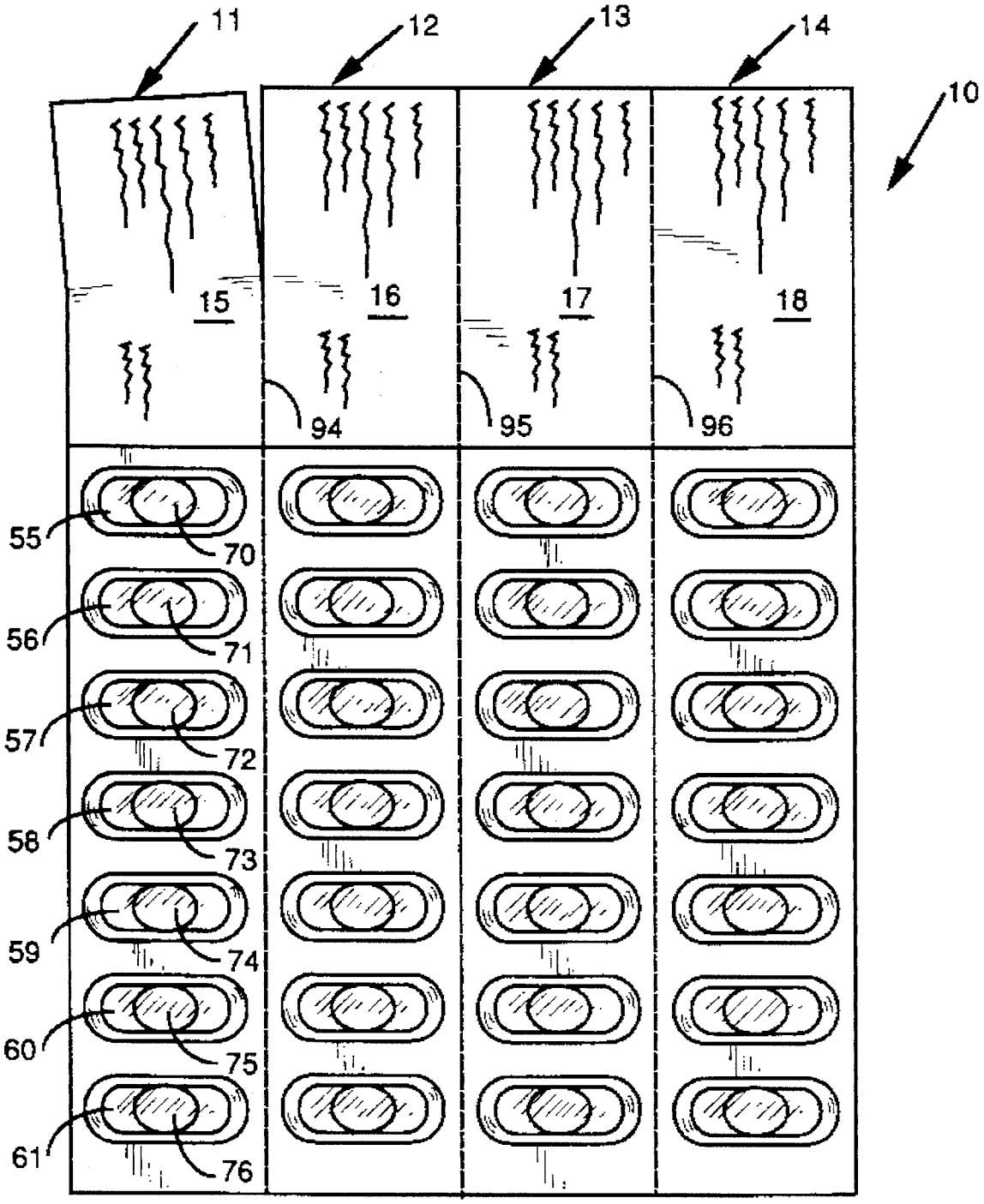
FIG. 3 is a view similar to FIG. 1 only showing a row of unit doses medication being partially separated from the card.
Figure 6:
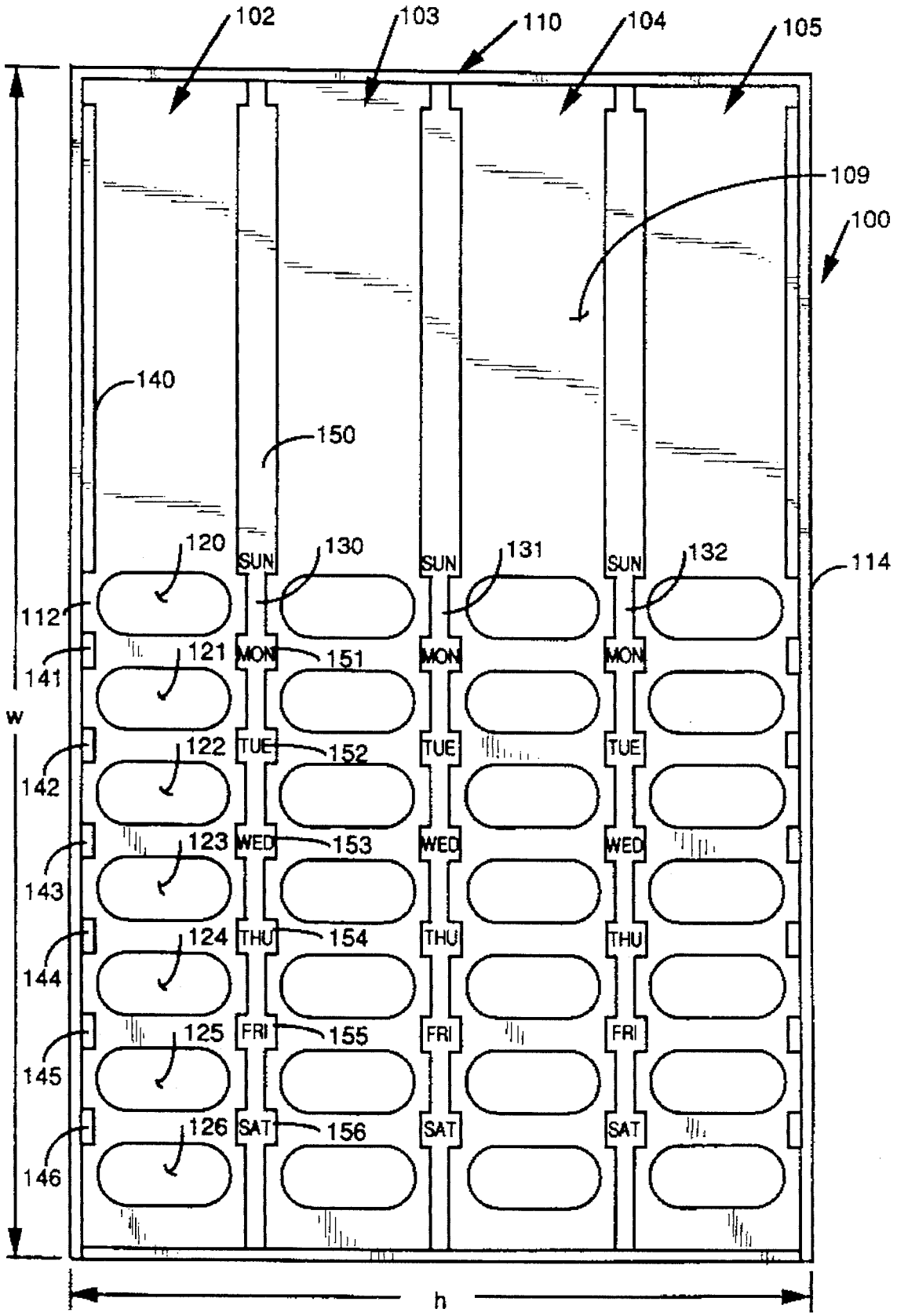
FIG. 6 is a top plan view of the carrier of the invention.
Figure 7:
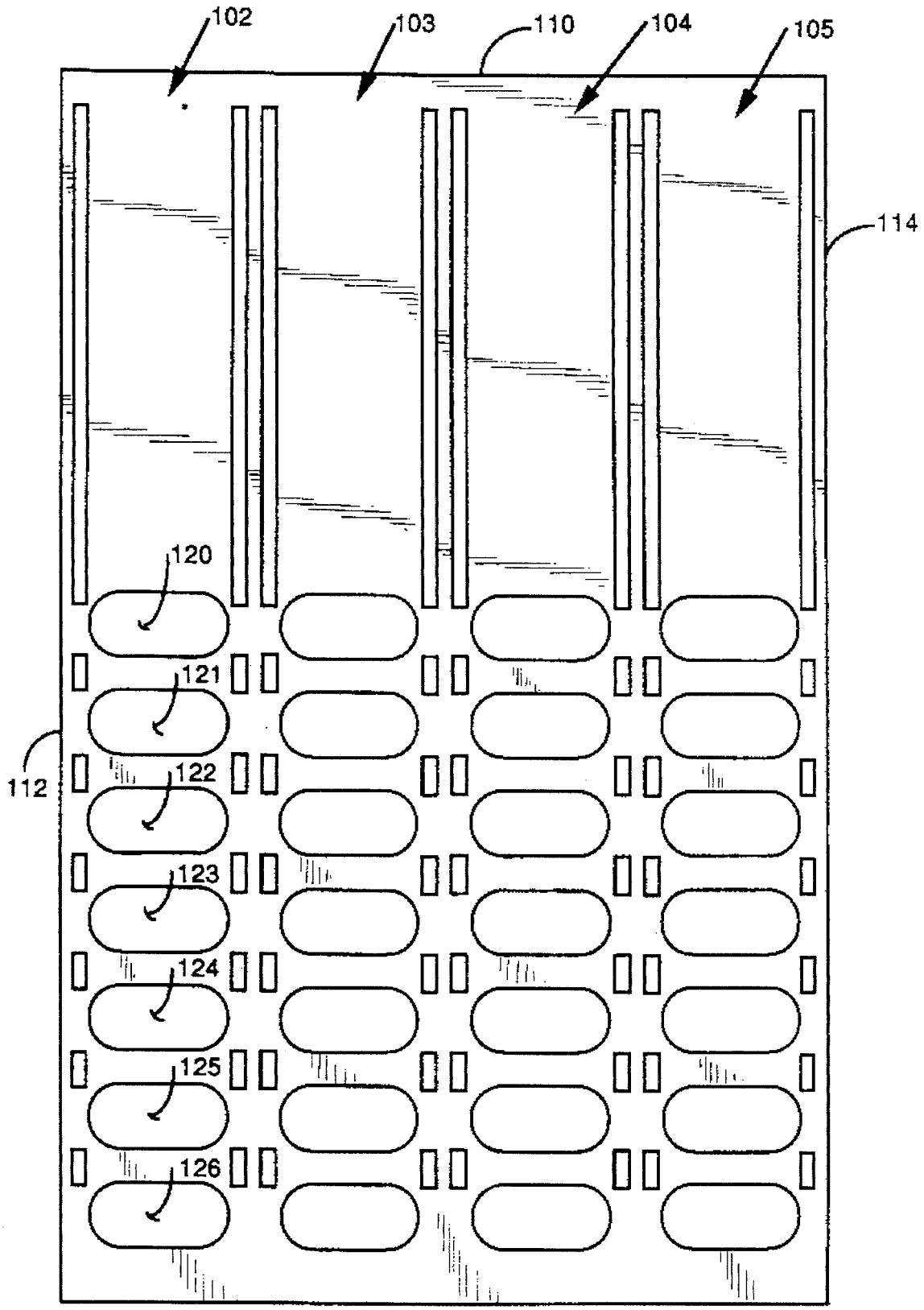
FIG. 7 is a bottom plan view of the carrier shown in FIG. 6.

Referring now to FIG. 3, row 11 is shown being partially separated from card 10. Because of weakened line 34 on the base 20, weakened line 65 in the blister pack 50 and weakened line 94 in the top portion 80, row 11 can be easily removed from the card 10. It will be appreciated that there are no weakened lines between the individual doses in row 11, as row 11 must stay intact for purposes of loading into the carrier 100 (FIG. 6). This insures integrity of the dosages by preventing tampering, pilferage and substitution.

Figure 4:
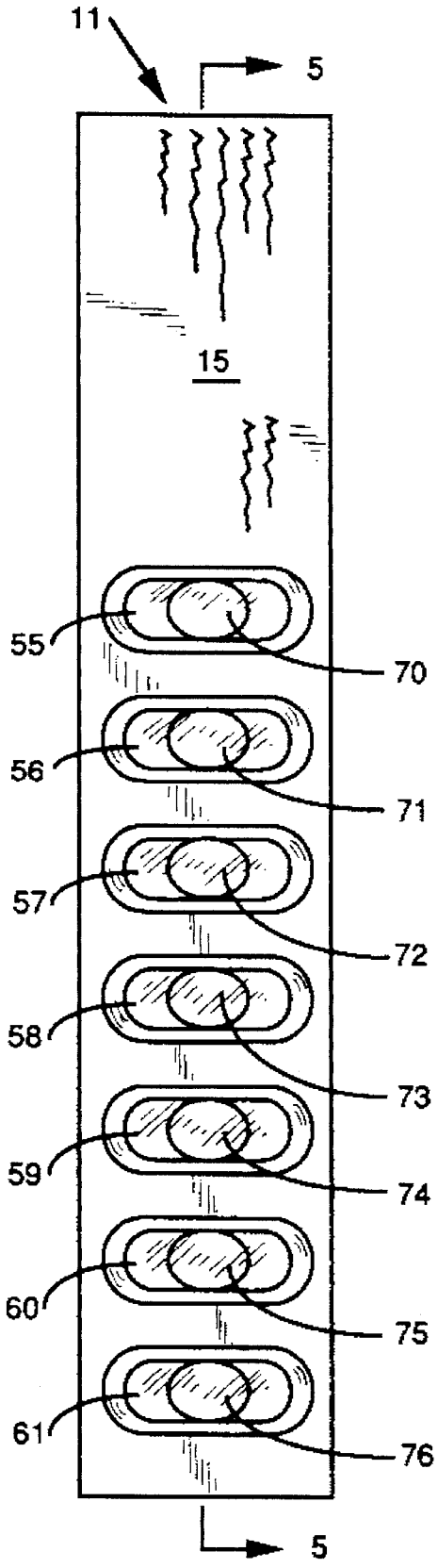
FIG. 4 is a top plan view of the row that was shown in FIG. 3 as being partially separated from the card.
Figure 5:
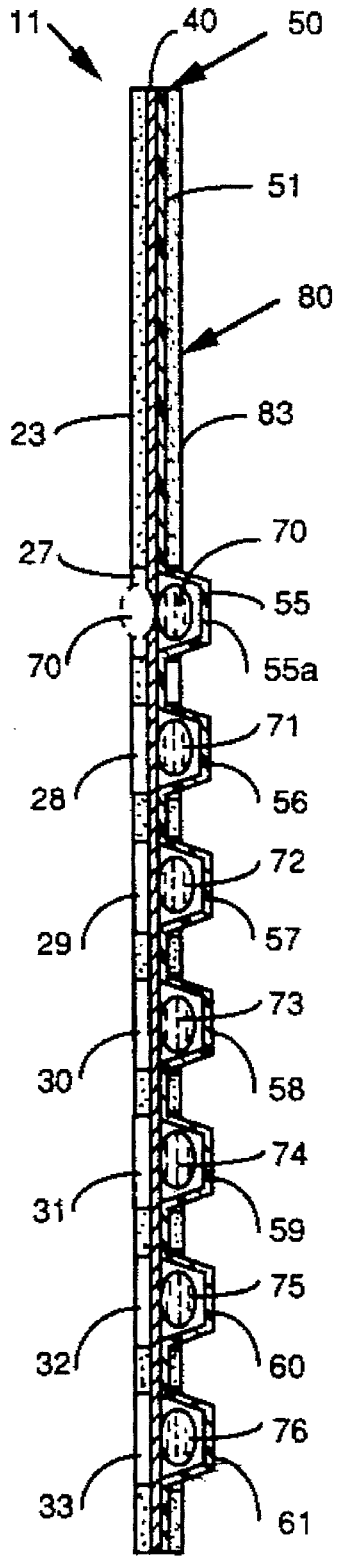
FIG. 5 is a cross-sectional view taken along line 5—5 of FIG. 4.

FIGS. 4 and 5 show the row 11 by itself. As can best be seen in FIG. 5, when it is desired to remove a unit dose of medication, such as unit dose of medication 70 from medication receiving recess 55, all a user has to do is push down on the upper surface **55*a* of medication receiving recess 55 to force unit dose 70 to break through the foil layer 40 and emerge from hole 27 of the base 23 of row 11**.

Referring now to FIG. 6, the carrier 100 of the invention will be discussed. The carrier 100 is preferably made of molded plastic and includes four slots 102, 103, 104 and 105 each of which conform in size to one row, such as row 11, of card 10. The carrier 100 preferably has a width w of about nine inches and a height h of about six inches. The carrier has a base 109, sidewall 110, a top wall 112, a bottom wall 114, and a sidewall 115. The sidewall 110, top wall 112 and bottom wall 114 extend generally perpendicularly from said base 109, and extend about ⅜ inch in height. Sidewall 115 also extends generally perpendicularly from the base 109, but only about 1/32 inch. This will facilitate sliding the rows into the carrier (FIG. 8) while also providing enough of a lip to retain the rows in the carrier 100.

Figure 9:
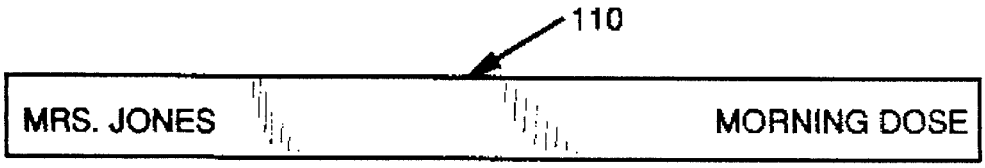
FIG. 9 is a side elevational view of the carrier showing indicia related to the patient name and time of day that the doses in the carrier are to be taken.

The sidewall 110, as will be explained with regard to FIG. 9, has space to accommodate the printing of indicia such as a patient's name, and the time of day (a.m., p.m., etc.) that the medications in carrier 100 are to be taken. It will be appreciated that although the invention is not limited to the dimensions and shapes disclosed therein, as one skilled in the art will easily recognize, the dimensions set forth herein for the carrier 100 are designed so that the carrier 100 can fit easily into standard medication carts used by health care institutions.

Each slot defines seven holes, such as slot 102 having holes 120, 121, 122, 123, 124, 125 and 126. As will be appreciated, these slots allow the unit dose of medication to pass from the row 11, through foil 40 and into the hands of a patient or nurse. The carrier 100 includes inner transverse walls 130, 131 and 132 which separate the slots 102, 103, 104 and 105. Disposed on the top edge of sidewalls 112 and 114 are overhanging flanges such as flanges 140, 141, 142, 143, 144, 145 and 146 on sidewall 112 and flange 147 on sidewall 114 which define a space between the base 109 and the flanges. Disposed on the inner transverse walls 130, 131 and 132 are double overhanging flanges, such as flanges 150, 151, 152, 153, 154, 155 and 156 on wall 130 and flange 157 on wall 131 and flange 158 on wall 132. As will be explained below with respect to FIG. 10, flanges 140–146 and flanges 150–156 secure a single row in the carrier 100. It will be appreciated that flanges 150–156 are marked with each day of the week, such as "SUN" on flange 150 in order to aid in dispensing the unit dose of medication from the carrier 100.

Figure 8:
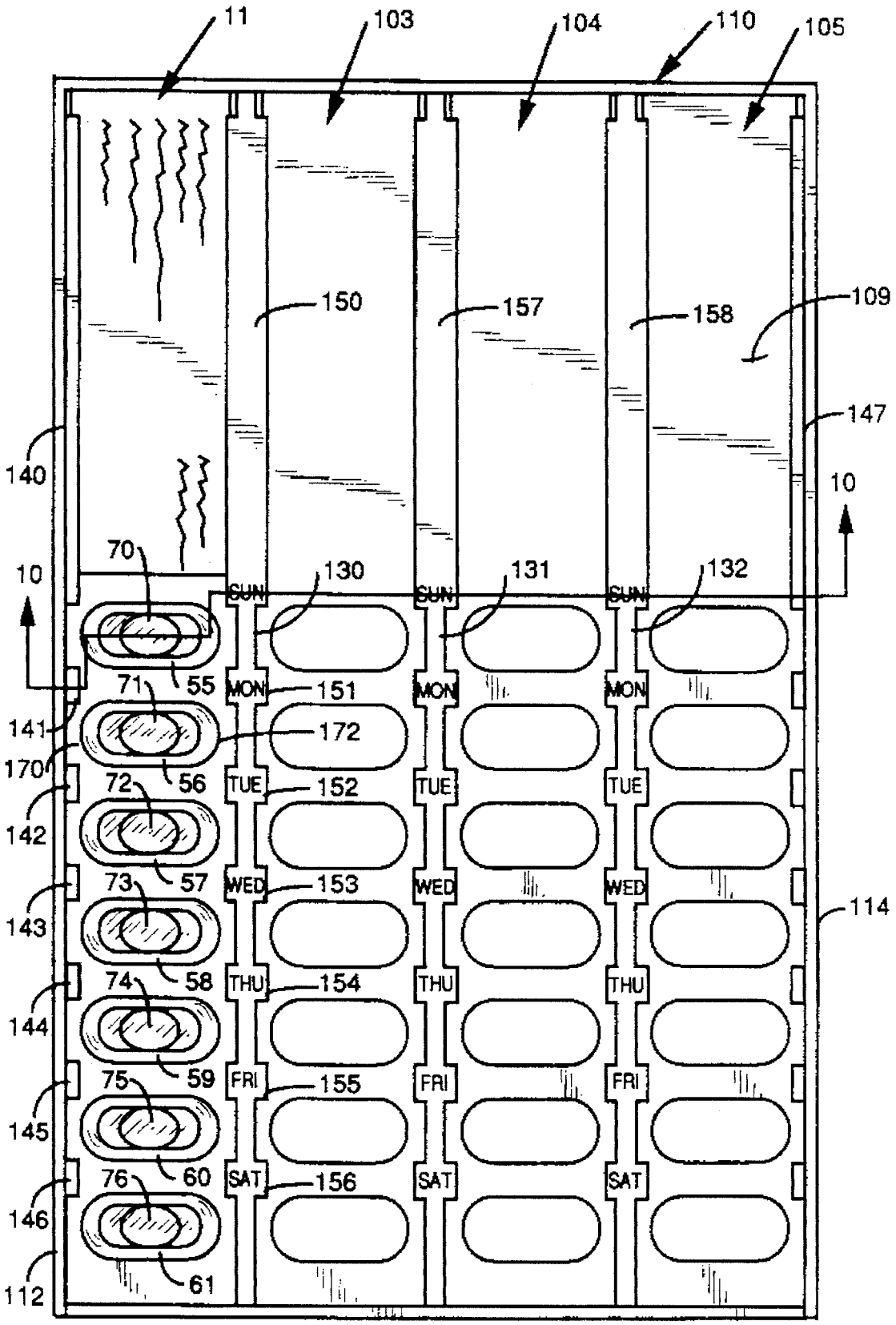
FIG. 8 is a plan view of the carrier shown in FIG. 6 with a row of unit doses of medication being placed therein.
Figure 10:
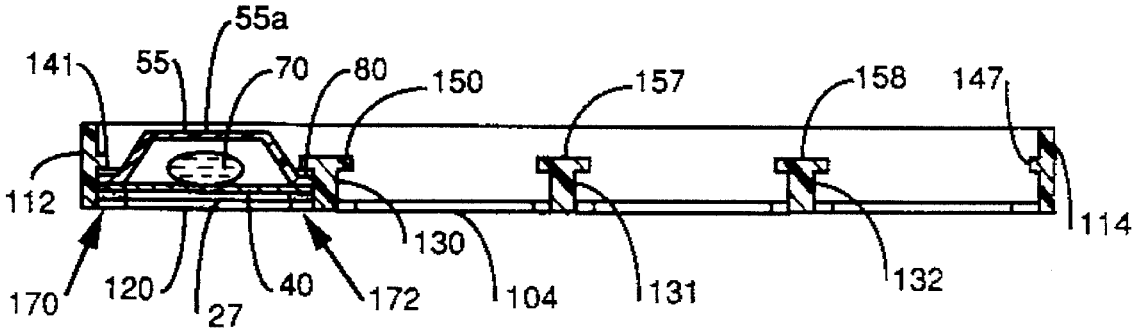
FIG. 10 is a cross-sectional view taken along line 10—10 of FIG. 8.

Referring now to FIGS. 8 and 10, the carrier 100 is shown containing the separated row 11 of FIG. 4. The longitudinal edges 170 and 172 of the row 11 are disposed in the space created by the flanges 140–146 of top wall 112 (flange 141 is shown in cross-section in FIG. 10) and base 109 and the flanges 150–156 of inner transverse wall 130 (flange 150 is shown in cross-section in FIG. 10) and base 109. The flanges retain the row 11 in slot 102 of the carrier 100. It will also be appreciated that the holes 27–33 of the base portion 22 of the card 10 align with the holes 120–126 of the base 109 of the carrier, such as hole 27 and hole 120 as shown in FIG. 10. In this way, the unit doses of medication 70 can be pushed through foil layer 40 and emerge through holes 27 and 120 to be removed from the carrier 100 and eventually given to a patient.

EXAMPLE

In order to more fully explain the method and products of the invention, an example is presented below.

Assume that a patient, Mrs. Jones, requires three separate prescription drugs. Prescription #1 must be taken four (4) times daily (morning, noon, dinner and bedtime); Prescription #2 must be taken once daily (morning); and Prescription #3 must be taken twice daily (morning and dinner time). These prescriptions are "maintenance" type drugs, such as high blood pressure medications, which are taken over long periods of time, although it will be appreciated that short term prescription drug dosing is also contemplated by the invention.

At the start of Mrs. Jones' program, a pharmacist would fill four separate cards, such as card 10 shown in FIG. 1, is with twenty-eight (28) unit doses of Prescription #1. The first card would be for the morning dose for 28 days (4 weeks); the second card would be for the noon dose for 28 days; the third card would be for the dinner time dose for 28 days; and the fourth card would be for the bedtime dose for 28 days.

It will be appreciated that the cards be filled by hand or semi-automatic equipment and can be filled in a pharmacy or in a manufacturing facility either by a pharmacist or technician supervised by a pharmacist as required by state law and regulation.

After this, the pharmacist removes the first row (containing 7 days (1 week) doses) from the first card and loads it into the first slot (such as slot 102) a first carrier, such as carrier 100 shown in FIG. 6. This carrier is the morning dose carrier. This carrier would be marked, as shown in FIG. 9, with the patient's name and the time of day (e.g., "morning dose") that the dose in this carrier is to be taken. The first card minus the first row is placed into a folder marked with the patient's name and the type of prescription and is kept by the pharmacist to supply the remainder of each week of the next three weeks' dosages in the same manner as was the first week's doses.

The pharmacist then removes the first row from the second card and loads it into the first slot of a second carrier. This carrier is the noon dose carrier. This carrier is also marked with the patient's name and the time of day (noon, in this case) when the doses in this carrier are to be taken. The second card minus the first row is marked with the patient's name and the type of prescription and is kept by the pharmacist to supply the remainder of each week of the next three weeks' dosages in the same manner as was the first week's dosages and placed into a folder for further use.

The pharmacist then removes the first row from the third card and loads it into the first slot of a third carrier. This carrier is the dinner time dose carrier. This carrier is also marked with the patient's name and the time of day (dinner, in this case) when the doses in this carrier are to be taken. The fourth card minus the first row is placed into a folder and marked with the patient's name and the type of prescription and is kept by the pharmacist to supply the remainder of each week of the next three weeks' dosages in the same manner as was the first week's dosages.

Finally, the pharmacist removes the first row from the fourth card and loads it into the first slot of a fourth carrier. This carrier is the bedtime dose carrier. This carrier is also marked with the patient's name and the time of day (bedtime, in this case) when the doses in this carrier are to be taken. The card is marked with the patient's name and the type of prescription and is kept by the pharmacist to supply the remainder of each week of the next three weeks'dosages in the same manner as was the first week's dosages and placed into a folder for further use.

Once a week's worth of Prescription #1 is loaded into the four carriers, a card is prepared for Prescription #2, again filling twenty-eight unit doses of medication of Prescription #2 into a card, such as card 10 of FIG. 1. The first row of this card is removed and is loaded into the morning dose carrier, discussed above, in the slot next to the first slot containing the row of unit doses of Prescription #1. The card is also placed into a folder and marked with the patient's name and the type of prescription and is kept by the pharmacist to supply the remainder of each week of the next three weeks' dosages in the same manner as was the first week's dosages.

As Prescription #2 is taken only once a day, there are no more cards and no more carriers to fill. The pharmacist then moves onto Prescription #3. As Prescription #3 is taken twice daily (morning and dinner time), two cards are prepared and twenty-eight unit doses of medication are placed into each card as is shown in FIG. 1. The first row of the first card is removed and is loaded into the morning dose carrier, discussed above, in the empty slot next to the second slot which contains the row of unit doses of Prescription #2. Thus, the morning carrier contains a first slot of Prescription #1, a second slot of Prescription #2 and a third slot of Prescription #3. The slot below the row of Prescription #3 remains empty.

Finally, the first row of the second card of Prescription #3 is removed and is loaded into the dinner time dose carrier in the empty slot next to the first slot that contains the row of unit doses of Prescription #1. Thus, the evening dose carrier contains a first slot of Prescription #1 and a second slot of Prescription #2. The two slots below the row of Prescription #3 remains empty.

The pharmacist then delivers to the patient, or to the health care institution, four carriers, i.e., the morning, noon, dinner time and bedtime carriers of unit doses of medications. The carriers are designated to fit a standard medical cart and are clearly labelled with the patient's name and the time of dosage, as is shown in FIG. 9. Each row of the unit dose of medication has a standard pharmacy label. When the time comes to administer the dosage, the patient or nurse merely pushes the unit dose of medication through the foil layer of the card thus removing the unit dose of medication from the card for subsequent ingestion by the patient.

At the end of the week, the carriers are returned to the pharmacist. The pharmacist, at that point, can easily observe whether all doses were taken. In addition, the pharmacist at that time can give credit for any unused doses. Preferably, the pharmacist has another set of four carriers which can be prepared and delivered to the health care institution before the used carriers are returned. In this way, the second week's dosages can be prepared ahead of time, and the pharmacist can review the used carrier without the time urgency of having to immediately fill the original carriers for return to the health care institution.

It will be appreciated that an efficient, accurate and easy to use system for dispensing unit doses of medication has been provided. The system tracks the use of prescriptions, increases patient compliance, reduces administration errors and improves the efficiency of the dispensing process. These advantages not only benefit the patient due to stricter patient compliance but also lead to cost effective dispensing of prescription drugs.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A method of dispensing unit doses of medications comprising:

providing a card including a blister pack having a plurality of medication receiving recesses, each of said recesses containing a unit dose of medication, said recesses being arranged in a plurality of rows with said rows having weakened lines therebetween;

separating a row of said unit doses of medication from said card by means of said weakened lines;

placing said separated row in a carrier, whereby said unit doses of medications in said separated row are available for dispensing to a patient;

employing a plurality of carriers for said patient, each carrier bearing information relating to the time of day when said unit dose of medication in said carrier is to be taken;

providing a plurality of cards for said patient, each containing a unit dose of a different type of medication;

separating a row of said unit doses of medication from each of said cards; and placing said rows in said carriers corresponding to said time of day when each said unit dose of medication in said carrier is to be taken.

2. The method of claim 1, including employing seven unit doses of medication to form each said row.

3. The method of claim 2, including employing four rows to form said card.

4. The method of claim 1, including providing said card with medication identifying indicia marked thereon.

5. The method of claim 1, including loading said carrier in a medication cart;

at least partially removing said carrier from said cart;

removing said unit dose of medication from said carrier; and delivering said unit dose of medication to said patient.

6. The method of claim 1, including providing said weakened lines solely in a generally longitudinal direction, whereby transverse separation of said blister pack is resisted.

7. The method of claim 1, including said card having a base defining a plurality of holes, a foil layer covering said holes and a top portion having a plurality of holes corresponding to said plurality of holes in said base, said blister pack being interposed between said foil layer and said top portion; and said medication receiving recesses being disposed over said plurality of holes in said base and extending from said plurality of holes in said top portion.

8. The method of claim 1, including performing said method in a pharmacy; and subsequently delivering said carrier to a health care institution where said patient is residing.

9. The method of claim 1, including performing said method in a pharmacy; and subsequently delivering said carrier to said patient.

* * * * *